US010683583B2

(12) United States Patent
Sarsanedas Millet

(10) Patent No.: US 10,683,583 B2
(45) Date of Patent: Jun. 16, 2020

(54) METHOD FOR SMOOTHING AND POLISHING METALS VIA ION TRANSPORT FREE SOLID BODIES AND SOLID BODIES FOR PERFORMING THE METHOD

(71) Applicant: DRYLYTE, S.L., Barcelona (ES)

(72) Inventor: Pau Sarsanedas Millet, Barcelona (ES)

(73) Assignee: DRYLYTE, S.L., Barcelona (ES)

( * ) Notice: Subject to any disclaimer, the term of this patent is extended or adjusted under 35 U.S.C. 154(b) by 86 days.

(21) Appl. No.: 16/008,818

(22) Filed: Jun. 14, 2018

(65) Prior Publication Data

US 2018/0298518 A1 Oct. 18, 2018

Related U.S. Application Data

(63) Continuation of application No. PCT/ES2017/070247, filed on Apr. 24, 2017.

(30) Foreign Application Priority Data

Apr. 28, 2016 (ES) ..... 201630542

(51) Int. Cl.
*C25F 3/16* (2006.01)
*C25F 7/00* (2006.01)
*B24B 31/00* (2006.01)

(52) U.S. Cl.
CPC ..... *C25F 3/16* (2013.01); *B24B 31/003* (2013.01); *C25F 7/00* (2013.01)

(58) Field of Classification Search
CPC ..... C25F 3/16; C25F 3/18; C25F 3/22; C25F 3/24; C25F 3/26; C25F 7/00; B24B 31/003
See application file for complete search history.

(56) References Cited

U.S. PATENT DOCUMENTS

| | | | | |
|---|---|---|---|---|
| 3,523,834 | A * | 8/1970 | Hewins | B23H 5/06 148/254 |
| 6,074,284 | A | 6/2000 | Tani et al. | |
| 6,739,953 | B1 | 5/2004 | Berman et al. | |
| 6,957,511 | B1 | 10/2005 | Leigh et al. | |
| 2003/0178320 | A1 | 9/2003 | Liu | |
| 2007/0017818 | A1 | 1/2007 | Emesh et al. | |
| 2017/0144239 | A1* | 5/2017 | Luo | B23H 5/08 |

FOREIGN PATENT DOCUMENTS

| | | | | |
|---|---|---|---|---|
| DE | 2031833 | A1 * | 12/1971 | B23H 5/06 |
| JP | 2002093758 | A | 3/2002 | |
| JP | 2008196047 | A | 8/2008 | |

OTHER PUBLICATIONS

Search Report in corresponding PCT Application No. PCT/ES2017/070247, dated Aug. 9, 2017, with English translation.
Extended European Search Report in related European Application No. 17788863.3, dated Jun. 14, 2019, 7 pages.

* cited by examiner

*Primary Examiner* — Nicholas A Smith
(74) *Attorney, Agent, or Firm* — Edell, Shapiro & Finnan, LLC

(57) ABSTRACT

A method for smoothing and polishing metals via ion transport by free solid bodies comprises connecting a part to be treated to a positive pole (anode) of a current generator and subjecting the part to friction with a set of particles comprising electrically conductive free solid bodies charged with negative electrical charge in a gaseous environment.

7 Claims, 1 Drawing Sheet

METHOD FOR SMOOTHING AND POLISHING METALS VIA ION TRANSPORT FREE SOLID BODIES AND SOLID BODIES FOR PERFORMING THE METHOD

CROSS REFERENCE TO RELATED APPLICATIONS

This application is a continuation of International Application No. PCT/ES/2017/070247, filed on Apr. 24, 2017, which claims priority under 35 U.S.C. § 119 to Application No. ES P201630542 filed on Apr. 28, 2016, the entire contents of which are hereby incorporated by reference.

TECHNICAL FIELD

This invention relates to a method for smoothing and polishing metals via ion transport by free solid bodies and also to the electrically conductive solid bodies to perform the method, providing advantages and characteristics of novelty that will be disclosed in detail herein and that provide a significant improvement over those currently known in the field of application.

An object of the invention concretely refers to a method for smoothing and polishing metal parts, for example dental prostheses, based on ion transport by small-sized free solid bodies (particles) that is distinguished, essentially, in that the bodies are electrically conductive and are placed together in a gaseous environment, the metal parts being arranged so that they are connected to the positive pole of a power supply, for example a DC generator and, preferably having motion, and the set of solid bodies (particles) so that it electrically contacts the negative pole of the power supply, the solid bodies being a second feature of the invention, in which particles capable of internally retaining an amount of electrolyte liquid so that they have an electrical conductivity, making them electrically conductive.

The field of application of the invention is within the sector of the industry engaged in burnishing and polishing metal parts, for example dental prostheses of stainless steel, especially including an electropolishing method by particles.

BACKGROUND

With reference to the state of the art, different systems for smoothing and polishing metals with free solid bodies (particles) are known. Thus, a great diversity of devices has been used over a time in which mechanical abrasion occurs by using particles not secured on any support, having different geometries and sizes and hardest than the material to be treated. Such devices produce friction of the particles on the parts to be treated thanks to the relative motion they produce between both. These devices consist, for example, of rotating receptacles (drum), vibrating receptacles, or particles blasters.

However, all systems based in direct mechanical abrasion, such as those mentioned above, have the serious defect that they affect the parts with little evenness, meaning that as a given proportionality exists between the pressure exerted by the abrasive (the particles) on the parts and the amount of eroded material, the protruding areas of the parts sustain a wear and rounding off that, in many cases, is excessive. In addition, the global mechanical energy delivered by these systems causes damage to the parts in many cases due to strokes and deformations for excessive stresses. On the other hand, systems based on mechanical abrasion produce surfaces on metal parts having plastic deformation and unavoidably occlude non-trivial amounts of foreign matters, making such treatment unsuitable in many cases due to contamination of the surface layers of the material.

Likewise, polishing systems by galvanic treatments are known, in which the metal parts to be treated are immersed in an electrolyte liquid and without solid particles as anodes, known as electropolishing. These methods have the advantage that they produce surfaces free of the surface contamination of the exclusively mechanical abrasive methods above disclosed. Now then, the levelling effect on the roughness of the order of more than a few microns that is achieved is, in many cases, insufficient and therefore the treatments are mostly used as finish of prior mechanical abrasion methods.

In addition, there exists galvanic methods in which the metal parts to be treated are immerged in an electrolyte liquid containing solid bodies (particles) that freely move within it. The electrolytes developed for the methods produce anodic layers thicker than in the case of the galvanic methods without particles, so that when the particles contained mechanically interact with the anodic layer, up to one-millimeter effective smoothing occurs on the roughness. However, as well in one case as in the other, the galvanic methods used up to now produce, in many cases, defects in the shape of pinholes or of stepped surfaces related to the structure and crystalline composition of the metal to be treated, their use remaining, in many cases, restrained to parts that, because of their composition (alloy) and molding treatment and forming, empirically proved that they can be treated without showing the defects in an unacceptable way.

SUMMARY

An objective of this invention therefore is to develop an improved smoothing and polishing system for metal parts that is effective and avoids the drawbacks and problems described above. The applicant is not aware of the existence of any other similar method of this type or invention that has its same characteristics, as it is claimed.

The method for smoothing and polishing metals via ion transport by free solid bodies and the electrically conductive solid bodies for carrying out the method that the invention proposes is therefore configured as a novelty within its field of application, because when it is implemented, the above mentioned objectives are satisfactorily achieved, the characterizing details making it possible and distinguishing it being conveniently included in the final claims attached to this specification.

Concretely, the invention relates to a method for smoothing and polishing metal parts, for example metal parts for dental prostheses, based on ion transport performed in a innovative manner with free solid bodies (particles) that are electrically conductive in a gaseous environment. The invention further relates to the solid bodies comprising particles having varied shapes with porosity and affinity to retain an amount of electrolyte liquid so that they have electrical conductivity.

More specifically, the method of the invention provides the following steps. The parts to be treated are connected to the positive pole (anode) of a current generator. After they are secured, the parts to be treated are subjected to friction with a set of particles constituted by electrically conductive free solid bodies charged with negative electrical charge in a gaseous environment, for example air.

The friction of the parts with the particles can be carried out for example by a stream of particles impelled by gas or expelled from a centrifugal mechanism or by a system with brushes, winders or any other suitable impelling element capable of moving and pressing the particles on the surface of the part.

In a preferred embodiment, the parts are introduced within a receptacle with a set of particles that are in contact with each other and with the negative pole (cathode) of the current generator. In this situation, the parts are moved with relation to the set of particles, for example following a circular motion.

As for the particles constituting such electrically conductive free solid bodies, they have a variable shape and size, that is suitable to smooth the roughness of the parts to be treated, being anyway bigger than the roughness to be removed. In addition, the particles possess porosity and affinity to retain an amount of electrolyte liquid, so that they have an electrical conductivity that makes them electrically conductive.

The amount of electrolyte liquid retained by the particles is always below the saturation level so that it is expressly avoided to leave free liquid on the surface of the particles. Preferably, the composition of the electrolyte liquid for polishing, for example, stainless steels is $H_2O$: 90-99% HF: 10-1%. In this manner, when the particles rub the parts to be polished, very accurately determine the embossed areas where the removal of metal occurs in an ionic form.

The main advantage is that, unlike the methods containing electrolyte liquids with free solid bodies, the inventive method is capable of virtually smoothing and polishing any metal alloy without producing effects due to uneven attacks of the surface.

As previously mentioned, often when using electrolytes with free solid bodies, pinholes and steps appear on the surface of the parts having been treated, being this the reflection of intrinsic differences of composition and characteristics between different areas of its crystalline structure.

In the method of this invention, the particles charged with electrolyte liquid rub the mass of the parts to be treated. In steady state of the method, all the time, there exists a diversity of electrical situations of the particles. Thus, in an extreme case, the case of particles exists acting as an electrical "bridge" by direct contact with other particles, between the parts and the cathode. In this case, the particle that contacts the part expels a given amount of electrolyte liquid making wet the area of the surface of the part and exercising an electro-erosion effect. The products of this electro-erosion (salts) locally exist in the area.

In another extreme case, there exists particles that contact the surface of the part in an isolated manner and after a maximum time without contacting other particles. In this case, the particle that contacts the part absorbs the rests (salts) of previous electro-erosion actions, produced by other particles.

And, further in another extreme case, the method would be that, when working using relative travelling speeds, part-particles, sufficiently high and applying at same time a sufficient electrical voltage, the possibility is maximized that a significant number of particles impinges on the surface of the parts in an isolated manner and provided, at same time, with sufficient electrical charge to provoke an effective electro-erosion.

In addition, between these three extreme cases an infinite diversity of intermediate cases also exists. Therefore, the high efficiency and accuracy of the method is explained by the quick succession, at steady state, of the contacts of the particles with the parts.

The ionic transport, anode-cathode, necessary to secure a stable behavior of the method occurs via diffusion through the particles. In addition, to a given extent, an anode-cathode transport can also occur of the set of particles that contributes to the ionic transport.

The method, expressly, also shows a relevant capacity of even smoothing and polishing at different dimensional scales. Thus, for example, for spherical particles having diameters ranging from 0.3 to 0.8 mm and average tangential speed of the set of particles with respect to the parts to be polished of the order of 1 to 3 m/sec, it is obtained at $mm^2$ scale, that means, on each square millimeter of the exposed surface of the parts to be treated, a specular finish with little roughness of a few nanometers. The spherical particles are preferably of a sulfonated styrene-divinylbenzene copolymer and with a microporous structure.

In turn, assessing the amount of metal removed between areas centimeters apart, a great homogeneity can be perceived. That means that the method of the invention possesses the capacity to level or equalize to a given extent the action of a great number of contacts (of each particle), despite they occur (the contacts) between a very large range of circumstances.

It is also very important to bear in mind that the method of the invention allows to adjust the parameters of all the elements that intervene, that means, voltage, average of tangential speed, content of electrolyte liquid, conductivity and chemical composition of the electrolyte liquid, percentage ratio between particles and surrounding gas.

When doing suitably and expressly such adjustment, it is achieved, at centimeter dimensional scale, to limit the electro-corrosive effect on the relatively exposed and protruding parts with respect to the more hidden parts. On the protruding parts, the local average tangential speed of the particles is higher than on the hidden parts. And, as the mentioned parameters are duly adjusted, it happens that the average of the times of individual contact (of each particle), on the protruding areas is below the average of the times of contact on the hidden areas, producing a lower electro-erosive yield on the protruding areas than on that achieved in the hidden areas. This is due to the fact that, in order there is an ion transport of the metal of the parts, first each area of contact has to be polarized up to a given threshold value which requests time and the method, as it can be duly adjusted, allows to do that this time necessary for the polarization works in the sense of equalizing results at centimeter dimensional scale. The low yield relative to the individual contacts on protruding parts is balanced by the higher number of them by unit of time and by unit of surface.

The method disclosed for smoothing and polishing metals via ion transport by free solid bodies and the electrically conductive solid bodies for carrying out the method comprises, therefore, in innovations having characteristics unknown up to now for the purpose to which they are designed, reasons that, jointly with their practical utility, provide them with sufficient foundation to obtain the privilege of exclusivity applied for.

BRIEF DESCRIPTION OF THE DRAWINGS

To complement the description that is been done and in order to assist to best understand the characteristics of the invention, to this specification is attached as an integral part thereof a sheet of drawing in which for illustration and no limiting purpose the following has been depicted.

DETAILED DESCRIPTION

Figure 1:
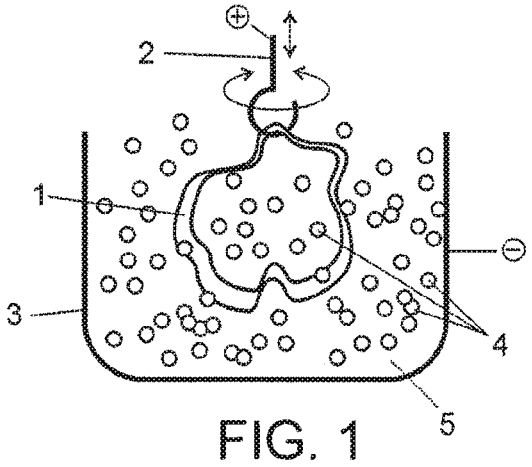
FIG. 1 shows a schematic depiction of the main elements intervening in the method for smoothing and polishing metals via ion transport by free solid bodies, object of the invention.

Seen the mentioned figures and in accordance with the numbering adopted in them, it can be seen how, in a preferred embodiment of the method of the invention, the metal parts (1) to be treated are secured by a securing element (2), also of metal, comprising hooks, clips, jaws or others, on a moving arm (not shown) of a device that can perform an orbital motion about an axis and on a plane and, at same time, it can perform a rectilinear and alternative displacement motion on the plane perpendicular to the orbital, depicted by arrow lines in the FIG. 1.

The parts (1) thus secured and with the mentioned orbital and of alternative linear displacement motion disabled, are introduced, by the top, in a receptacle (3) of the device that contains a set of electrically conductive particles (4) and the air or any other gas occupying the space (5) of its interstitial environment existing between them, so that the parts (1) remain fully covered by the set of particles (4).

Preferably, the shape of the receptacle (3) is that of a cylinder with the lower end or bottom, closed and the top end open.

In any case, the securing element (2) is connected to the anode or positive pole of an electrical current generator (not shown) provided in the device while the receptacle (3), either directly because of being of metal or through a ring provided to that effect, is connected to the negative pole of the generator acting as cathode.

Logically, the device firmly secures the cylinder forming the receptacle (3) so that it avoids its displacement when activating the orbital motion and the alternative linear displacement of the securing element (2) of the parts (1).

Last, it shall be pointed out that the amplitude of the motion of the securing element (2) provided by the arm of the device, not shown, and the sizes of the receptacle (3) that contains the particles (4) is such that, in no case it is possible that the parts (1) to be treated or any conductive part of the securing element (2) directly contacts the walls of the receptacle or, where appropriate, the ring acting as cathode.

Figure 2:
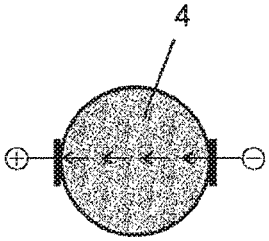
FIG. 2 shows a schematic depiction of a particle forming the solid bodies that the method presents, according to the invention, its porous configuration and capacity for retaining electrolyte liquid that makes it electrically conductive can be seen.

Considering FIG. 2, it can be seen how the particles (4) that constitute the free electrically conductive solid bodies of the method according to the invention, are solid bodies with porosity and affinity to retain an amount of electrolyte liquid in order that they have electric conductivity, the amount of electrolyte liquid being retained by the particles (4) always below the saturation level, so that the existence of free liquid is expressly avoided on the surface of the particles.

Preferably, the composition of the electrolyte liquid for polishing, for example stainless steels, is $H_2O$: 90-99% HF: 10-1%.

Figure 3:
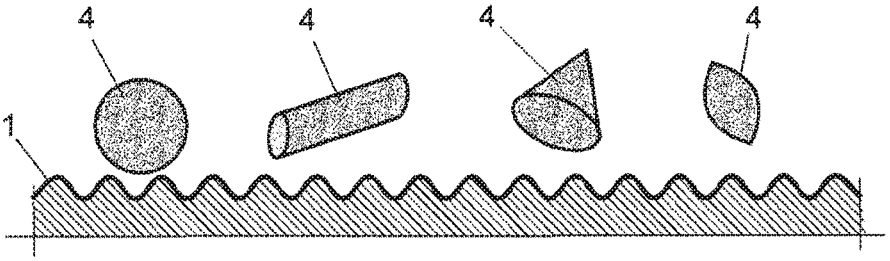
FIG. 3 shows a schematic depiction of a portion of rough surface of the part to be treated and several examples of the possible shapes the particles used in the method can have, and the difference of size between them and the size of the roughness can be symbolically seen; and last.

On the other hand, as shown by the examples of the FIG. 3, the particles (4) are bodies that have variable shape and size, suitable to smooth the roughness of the parts (1) to be treated and being preferably bigger than the roughness to be removed from the surface.

Figure 4:
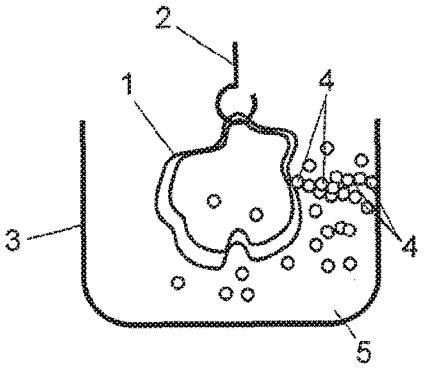
FIGS. 4 and 5 each show sketches similar to the one depicted in the FIG. 1, that draw respective moments of the method, the one of the FIG. 4 being the case in which a group of particles forms an electric bridge of direct contact between the anode and the cathode, and the FIG. 5, another case in which the particles separately brush the surface of the part.
Figure 5:
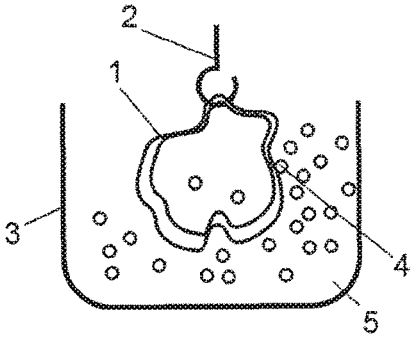

Last, in FIGS. 4 and 5, two examples have been depicted of extreme case of the method by which smoothing and polishing the parts (1) is achieved through the contact between the electrically conductive particles (4) and the surface of the part (1) to be treated, FIG. 4 showing the case in which a group of particles (4) constitute an electric bridge of direct contact between the anode, through the securing element (2) in contact with the metal part (1) and the cathode, through the receptacle (3) and FIG. 5, the case in which the particles (4) separately brush the surface of the part (1), as it was explained in the preceding paragraphs.

The nature of this invention having been sufficiently disclosed, as well as the manner for implementing it, it is not deemed necessary to extend any longer its explanation in order that any person skilled in the art understands its extent and the advantages arising from it, and it is stated that, within it essence, it can be implemented in other embodiments differing in detail of that indicated for example purpose and to which the protection sought shall extend, provided that its fundamental principle is not altered, changed or modified.

What is claimed is:

1. A method for smoothing and polishing metals via ion transport by free solid bodies, the method comprising:

connecting a part to be treated to a positive pole (anode) of a current generator; and subjecting the part to friction with a set of particles comprising electrically conductive free solid bodies charged with a negative electrical charge in a gaseous environment.

2. The method of claim 1, further comprising:

positioning the part within a receptacle, wherein the set of particles is disposed within the receptacle and electrically contacts a negative pole (cathode) of the current generator.

3. The method of claim 2, wherein the receptacle is electrically connected to the negative pole of the current generator such that the electrical contact of the particles with the negative pole of the current generator is carried out through the receptacle acting as the cathode.

4. The method of claim 2, wherein a ring disposed in the receptacle is electrically connected to the negative pole of the current generator such that the electrical contact of the particles with the negative pole of the current generator is carried out through the ring acting as the cathode.

5. The method of claim 1, further comprising:

securing the part to a securing element coupled to a device capable of moving the part relative to the set of particles, wherein the friction between the part and the set of particles results from motion of the part imparted by the device.

6. The method of claim 5, wherein the motion imparted to the part by the device is an orbital motion about an axis and on a plane and, simultaneously, a rectilinear and alternative motion in a plane perpendicular to the orbital motion.

7. The method of claim 1, wherein the gaseous environment occupying interstitial space between the particles is air.

* * * * *